US008973379B2

(12) United States Patent
Bittner et al.

(10) Patent No.: US 8,973,379 B2
(45) Date of Patent: Mar. 10, 2015

(54) REFRIGERATION CONTROL SYSTEMS AND METHODS FOR MODULAR COMPACT CHILLER UNITS

(75) Inventors: John D. Bittner, Bethlehem, GA (US); Vincent R. Rose, Conyers, GA (US); Peter J. Ferretti, Loganville, GA (US)

(73) Assignee: Hill Phoenix, Inc., Conyers, GA (US)

( * ) Notice: Subject to any disclaimer, the term of this patent is extended or adjusted under 35 U.S.C. 154(b) by 1451 days.

(21) Appl. No.: 12/508,374

(22) Filed: Jul. 23, 2009

(65) Prior Publication Data

US 2010/0023171 A1 Jan. 28, 2010

Related U.S. Application Data

(60) Provisional application No. 61/083,812, filed on Jul. 25, 2008.

(51) Int. Cl.
*F25B 7/00* (2006.01)
*F25B 49/02* (2006.01)
*F25B 25/00* (2006.01)

(52) U.S. Cl.
CPC ..... *F25B 49/02* (2013.01); *F25B 25/005* (2013.01); *F25B 2339/047* (2013.01); *F25B 2400/06* (2013.01); *F25B 2400/22* (2013.01); *F25B 2500/26* (2013.01); *F25B 2500/27* (2013.01); *F25B 2600/01* (2013.01); *F25B 2600/21* (2013.01); *F25B 2600/2513* (2013.01)
USPC ..... 62/79

(58) Field of Classification Search
USPC ..... 62/228.3, 259.1, 79, 99, 181, 183, 246, 62/506, 175, 441, 442
See application file for complete search history.

(56) References Cited

U.S. PATENT DOCUMENTS

| | | | | |
|---|---|---|---|---|
| 4,227,862 | A * | 10/1980 | Andrew et al. | 417/12 |
| 4,602,484 | A * | 7/1986 | Bendikson | 62/158 |
| 4,655,279 | A * | 4/1987 | Harmon, Jr. | 165/267 |
| 4,765,150 | A | 8/1988 | Persem | |
| 4,852,362 | A * | 8/1989 | Conry | 62/175 |
| 5,265,434 | A * | 11/1993 | Alsenz | 62/117 |
| 5,533,347 | A * | 7/1996 | Ott et al. | 62/115 |
| 5,586,444 | A | 12/1996 | Fung | |
| 6,298,673 | B1 | 10/2001 | Fung et al. | |
| 6,471,486 | B1 * | 10/2002 | Centers et al. | 417/18 |
| 6,564,862 | B1 | 5/2003 | Persson | |
| 6,981,385 | B2 | 1/2006 | Arshansky et al. | |
| 7,065,979 | B2 | 6/2006 | Arshansky et al. | |
| 7,159,413 | B2 | 1/2007 | Dail | |
| 7,275,376 | B2 | 10/2007 | Swofford et al. | |
| 7,367,198 | B2 * | 5/2008 | Behr | 62/89 |
| 7,849,701 | B2 | 12/2010 | Bittner | |
| 7,913,506 | B2 | 3/2011 | Bittner et al. | |
| 2006/0201175 | A1 * | 9/2006 | Shapiro et al. | 62/246 |
| 2006/0236708 | A1 * | 10/2006 | Mizuno et al. | 62/228.3 |

(Continued)

OTHER PUBLICATIONS

New Harris Teeter Store Showcases First Hill Phoenix Second Nature Compact Chiller Units in North America, Hill Phoenix, Inc., May 7, 2008, 9 pages.

*Primary Examiner* — Jonathan Bradford
(74) *Attorney, Agent, or Firm* — Foley & Lardner LLP

(57) ABSTRACT

A controller for a modular compact chiller unit configured for integration into a refrigeration system utilizing a plurality of modular compact chiller units is shown and described. The controller includes a processing circuit configured to provide startup control, operational control, and shutdown control for the modular compact chiller unit.

17 Claims, 8 Drawing Sheets

(56) References Cited

U.S. PATENT DOCUMENTS

| | | | | |
|---|---|---|---|---|
| 2008/0141698 | A1* | 6/2008 | Hanson | 62/324.1 |
| 2008/0148751 | A1 | 6/2008 | Swofford | |
| 2008/0209921 | A1 | 9/2008 | Swofford | |
| 2009/0031740 | A1* | 2/2009 | Douglas | 62/225 |
| 2009/0126909 | A1* | 5/2009 | Ellsworth et al. | 165/104.33 |
| 2009/0133416 | A1 | 5/2009 | Swofford et al. | |
| 2009/0217686 | A1 | 9/2009 | Bittner | |
| 2009/0293523 | A1 | 12/2009 | Bittner et al. | |
| 2010/0028669 | A1 | 2/2010 | Habu et al. | |
| 2010/0031697 | A1 | 2/2010 | Hinde et al. | |

* cited by examiner

REFRIGERATION CONTROL SYSTEMS AND METHODS FOR MODULAR COMPACT CHILLER UNITS

CROSS-REFERENCE TO RELATED PATENT APPLICATIONS

The present application claims the benefit of U.S. Provisional Application No. 61/083,812, filed Jul. 25, 2008, incorporated herein by reference in its entirety.

BACKGROUND

The present disclosure relates generally to the field of refrigeration. The present disclosure relates more particularly to a control system and method for use with modular compact chiller units in refrigeration applications.

It is known to provide a refrigeration system including a refrigeration device or temperature controlled storage device such as a refrigerated case, refrigerator, freezer, or the like for use in commercial and industrial applications involving the storage or display of objects, products and materials. For example, it is known to provide a refrigeration system having one or more refrigerated cases for display and storage of frozen or refrigerated foods in a supermarket to maintain the foods at a suitable temperature (e.g., 32 to 35 deg.F, −20 to 55 deg.F, etc.). Various configurations of refrigeration systems (e.g., a direct expansion system, a secondary coolant system, etc.) are used to provide a desired temperature within a space in a refrigeration device such as a refrigerated case (e.g., by supply of coolant). Conventional refrigeration systems typically utilize a single refrigeration cycle through which a relatively large amount of refrigerant flows.

SUMMARY

One embodiment relates to a controller for a modular compact chiller unit configured for integration into a refrigeration system utilizing a plurality of modular compact chiller units. The controller includes a processing circuit configured to provide startup control, operational control, and shutdown control for the modular compact chiller unit. The controller further includes an expansion valve interface configured to provide control signals to an expansion valve of the compact chiller module. The controller yet further includes a compressor interface configured to provide control signals to a compressor of the modular compact chiller unit.

Another embodiment relates to a refrigeration system for providing chilled fluid to cooling loads. The refrigeration system includes a main controller and a plurality of modular compact chiller units. The refrigeration system further includes a chilled fluid system configured to allow the chilled fluid to be chilled by the plurality of modular compact chiller units. Each of the plurality of modular compact chiller units includes a controller configured to receive control signals from the main controller and to provide startup control, operational control, and shutdown control for its associated modular compact chiller unit. In some embodiments, the main controller is configured to cause the modular compact chiller units to turn on, one at a time, in order to meet a chilled fluid temperature setpoint.

Another embodiment relates to a method for starting a modular compact chiller unit that is a part of a larger refrigeration system utilizing a plurality of modular compact chiller units. The method includes receiving a call for cooling signal from a main controller for the refrigeration system. The method further includes, in response to the call for cooling signal, beginning a startup routine. The startup routine includes opening an expansion valve to a pre-start position after a delay time has expired. The startup routine further includes receiving a signal from a pressure sensor representative of the pressure on the inlet side of a compressor for the modular compact chiller unit. The startup routine yet further includes comparing the signal representative of pressure to a threshold and providing a control signal to the compressor for the modular compact chiller unit causing the compressor to activate for normal operation when the pressure is greater than the threshold.

Alternative exemplary embodiments relate to other features and combinations of features as may be generally recited in the claims.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Before turning to the figures which illustrate the exemplary embodiments in detail, it should be understood that the disclosure is not limited to the details or methodology set forth in the description or illustrated in the figures. It should also be understood that the terminology is for the purpose of description only and should not be regarded as limiting.

Referring generally to the figures, one or more modular compact chiller units are provided to a refrigeration system. The modular compact chiller units include a refrigeration circuit including at least an expansion valve and a compressor. The evaporator portion of the refrigeration circuit is configured to transfer heat from (e.g., chill) fluid in a chilled fluid system. The chilled fluid is delivered to loads such as refrigeration cases. At least the expansion valve and the compressor are controlled by a controller for each modular compact chiller unit.

Figure 1:
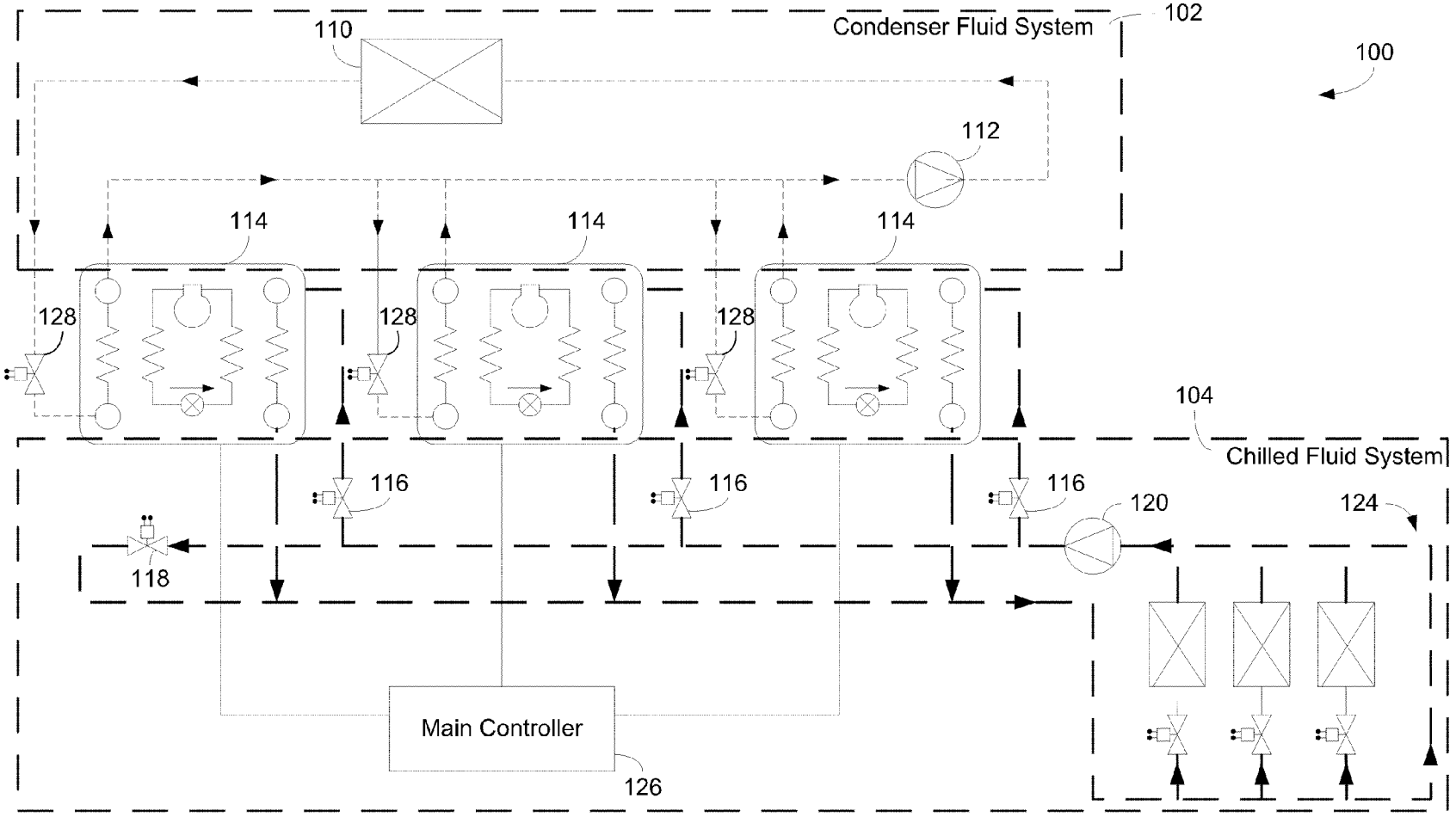
FIG. 1 is a diagram of a refrigeration system having multiple modular compact chiller units, according to an exemplary embodiment.

Referring to FIG. 1, a block diagram of a refrigeration system 100 is shown, according to an exemplary embodiment. Refrigeration system 100 is generally configured to provide a cooling function to one or more refrigeration loads 122 (e.g., medium temperature loads, low temperature loads, etc.) through a chilled fluid system 104. Chilled fluid system 104 is configured to deliver cooling fluid (e.g., a water and glycol mix, etc.) to loads 122. Refrigeration system 100 can be implemented for use in a super market, food retail facility, a cooling freezer application, a walk-in cooler application, a cold storage and/or display case application, or any other system where refrigeration is needed. Refrigeration loads 122 may include devices from any one or more of the aforementioned applications or otherwise.

Chilled fluid system 104 shown in FIG. 1 is generally a hydraulic system that transfers heat (e.g., provides chilling) by circulating a chilled fluid through a system of pipes. According to an exemplary embodiment, the fluid circulating through chilled fluid system 104 is a liquid coolant and is not a direct expansion refrigerant. Other embodiments may utilize a refrigerant as a secondary coolant circulating through chilled fluid system 104.

Figure 2:
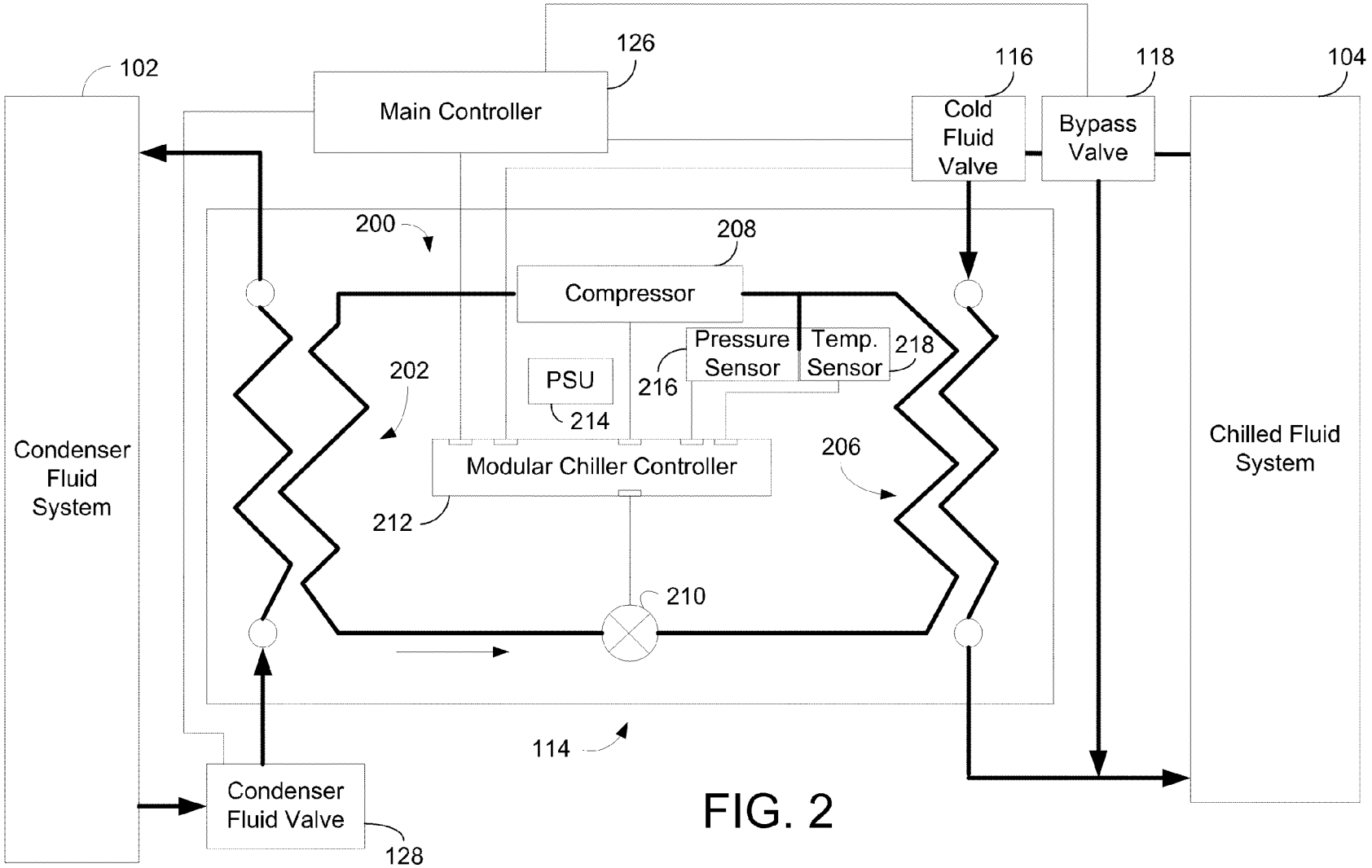
FIG. 2 is a block diagram of one of the modular compact chiller units shown in FIG. 1 and is connected to the condenser fluid system and the chilled fluid system of FIG. 1, according to an exemplary embodiment.

Referring now to FIGS. 1 and 2, each modular compact chiller unit 114 includes a vapor compression type refrigeration circuit having a compressor 208 and an expansion valve 210 (e.g., throttle valve, etc.). The refrigeration circuit within each modular chiller unit 114 further includes a condenser portion 202 and an evaporator portion 206 (e.g., heat exchanger portion) which generally operates as follows. Refrigerant is compressed by compressor 208, resulting in a high pressure and temperature gas. The pressurized and heated gas is then provided to the condenser portion 202. The cooling provided by the condenser generally changes the refrigerant from the high temperature gas to a warm temperature liquid. The liquid is provided to expansion valve 210 (i.e., thermal expansion valve). Expansion valve 210 converts the liquid (which is under pressure) to a cold saturated gas. Expansion valve 210 can be configured to variably meter the amount of refrigerant flowing through the valve. Evaporator portion 206 receives heat from the fluid in chilled fluid system 104 which evaporates the saturated gas into a cool dry gas or vapor. Compressor 208 then compresses on the gas (creating superheated vapor) and the cycle repeats itself. Evaporator portion 206 removes heat from chilled fluid system 104 (chilling the fluid of chilled fluid system 104) for providing cooling to refrigeration loads 122. Condenser portion 202 transfers heat to condenser fluid system 102 for conducting the cooling that converts the pressurized and heated gas into liquid.

While condenser portion 202 is shown to interface with condenser fluid system 102, it should be noted that condenser portion 202 could use fans or any other cooling mechanism to cool the gas provided to the condenser portion 202 by compressor 208. In other words, in some embodiments condenser fluid system 102 may be removed from the system or significantly modified. Fluid cooler 110 cools the condenser fluid pumped through condenser fluid system 102 by condenser fluid pump station 112.

Chilled fluid system 104 is shown to include pump station 120 which circulates the chilled fluid through the system. Main controller 126 is configured to control valve 118 as well as to provide control signals to modular compact chiller units 114. Main controller 126 can be connected to one or more modular chiller controllers. According to an exemplary embodiment, main controller 126 is connected to each modular chiller controller such as those shown in FIGS. 2 and 3.

Referring to FIG. 2, a close-up block diagram of a single modular compact chiller unit 114 is shown, according to an exemplary embodiment. FIG. 2 illustrates a single modular compact chiller unit 114 for simplicity, but it should be understood that one or more modular compact chiller units may be connected in parallel to main controller 126 with the modular compact chiller unit 114, condenser fluid system 102, chilled fluid system 104, or any other refrigeration system 100 component. According to the embodiment shown in FIG. 2, each modular chiller 114 is configured to be associated with or include a local modular chiller controller 212. Controller 212 is generally configured to receive one or more commands (e.g., a run command, a stop command, a setpoint command, etc.) from main controller 126 and to provide startup control, operational control, and shutdown control for modular compact chiller unit 114.

Controllers 212 allow each modular compact chiller unit 114 to be controlled by its own circuitry (e.g., a single circuit board, a set of circuit boards, etc.) and easily swapped in or out for replacement units, new units, or otherwise. According to an exemplary embodiment, each controller 212 is powered by a power source (e.g., PSU 214) and/or power supply circuitry local to the controller's associated modular compact chiller unit. Each modular chiller controller 212 can be mounted inside a frame, housing, or other casing for modular compact chiller unit 114. However, according to various other exemplary embodiments, a portion of or all of modular chiller controller 212 is mounted on or projects from the frame, housing, or other casing for modular compact chiller unit 114.

According to an exemplary embodiment, compressor 208, a chilled fluid valve 116, and an electronic expansion valve 210 are controlled by controller 212 for each modular compact chiller unit. Further, controller 212 may be configured to monitor the following inputs: suction and discharge pressures, temperatures, and protection circuitry for compressor 208 (e.g., a scroll compressor's internal protector, etc.). Controller 212 includes circuitry for adjusting electronic expansion valve 210 to maintain setpoints. For example, controller 212 is preferably configured to variably and continuously control expansion valve 210 based on a superheat setpoint for the refrigeration loop 200 of the modular compact chiller unit. To accomplish such control, for example, controller 212 may be or include a proportional-integral-derivative (PID) circuit configured to seek the superheat setpoint based on feedback received from pressure sensor 216 and temperature sensor 218. Controller 212 may be configured to receive signals beyond what are used for normal control activities. For example, controller 212 may be configured to receive signals regarding liquid temperature that may be used for service or troubleshooting purposes (e.g., sense alarm conditions).

Figure 4:
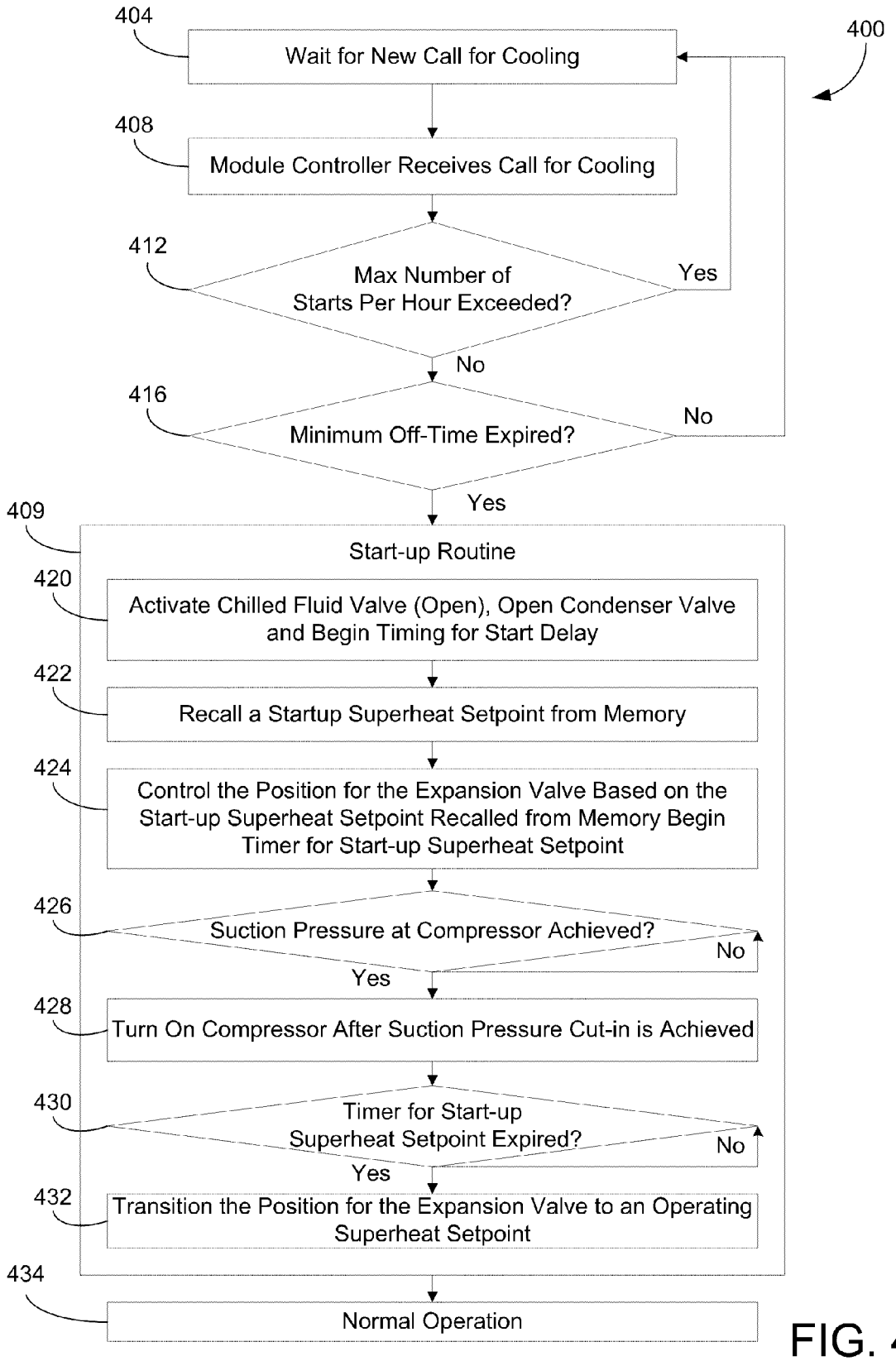
FIG. 4 is a flow chart of a process for starting and operating a modular compact chiller unit using a controller associated with each modular compact chiller unit (e.g., the controller of FIGS. 2 and 3), according to an exemplary embodiment.
Figure 5:
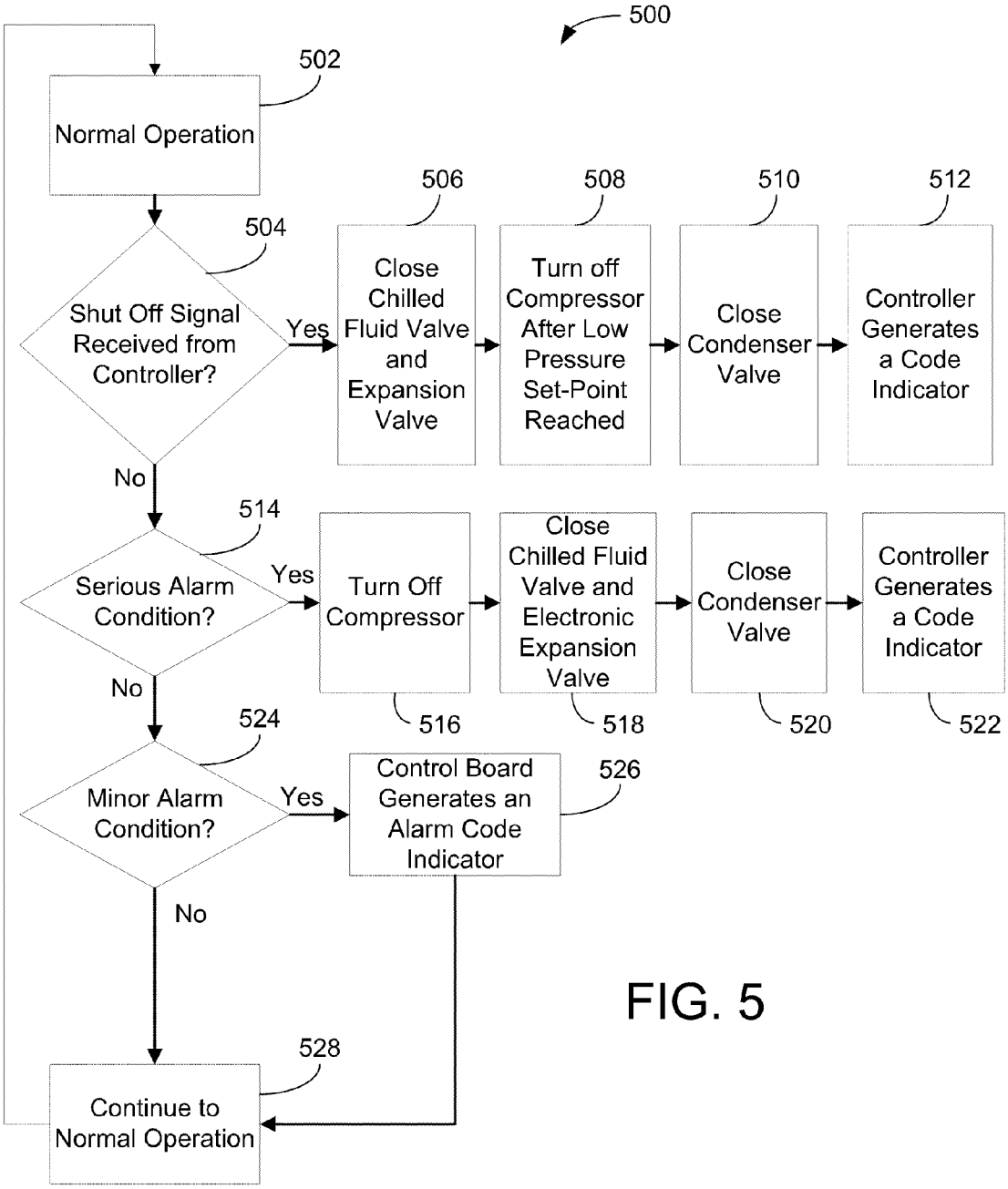
FIG. 5 is a flow chart of a process for operating a modular compact chiller unit using a controller such as the controller shown in FIGS. 2 and 3, according to an exemplary embodiment.

Referring further to FIGS. 1 and 2, each modular compact chiller unit includes a condenser valve 128 that is upstream of the chiller unit's condenser portion 202. Similarly, each modular compact chiller unit includes a chilled fluid valve 116 that is upstream of an evaporator portion 206. Upon insertion into a refrigeration system, a modular compact chiller unit may be coupled to the condenser fluid system and chilled fluid system but valves 128 and 116 prevent condenser fluid or chilled fluid from flowing through the modular compact chiller unit until the unit is activated. FIG. 4, described below, illustrates exemplary startup logic for controller 212 that makes use of valves 116, 128. FIG. 5, also described below, illustrates exemplary alarm or shutdown logic for controller 212 that closes valves 116, 128 in concert with other system shutdown activities. Bypass valve 118 may be controlled by master controller 126 to cause some liquid of chilled fluid system to bypass the modular compact chiller units (e.g., reducing chilled fluid pressure of chilled fluid). Main controller's logic with respect to bypass valve 118 is described below with reference to FIGS. 6-8.

Figure 3:
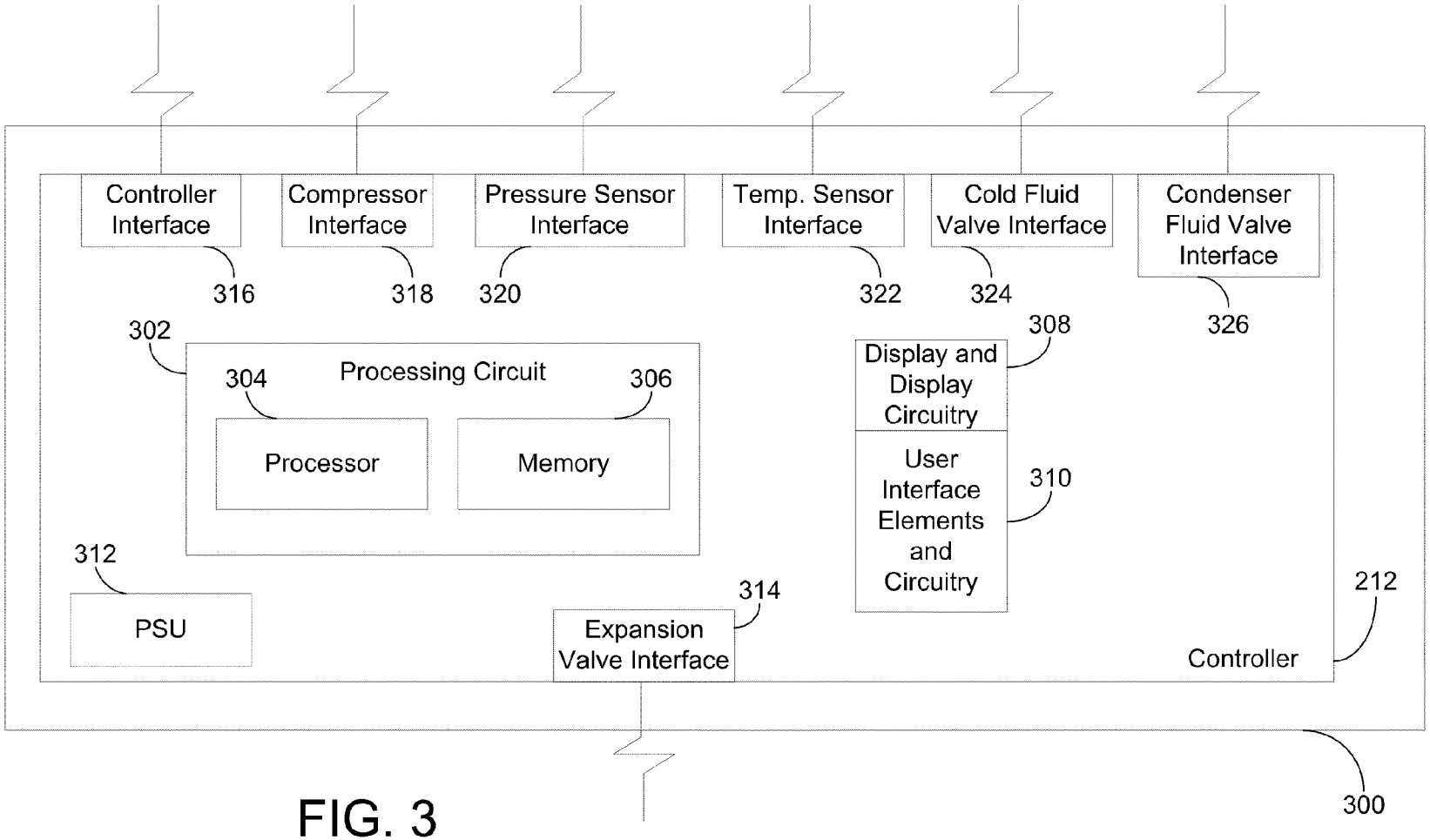
FIG. 3 is a close-up block diagram of the modular chiller controller shown in FIG. 2, according to an exemplary embodiment.

Referring now to FIG. 3, a close-up block diagram of modular chiller controller 212 shown in FIG. 2 is illustrated, according to an exemplary embodiment. Modular chiller controller 212 is shown to include a variety of interfaces 314-326. Interfaces 314-326 can be any wired or wireless (e.g., utilizing RF communications, infrared communications, etc.) interfaces. For example, interfaces 314-326 can be terminal interfaces, optical interfaces, electrical interfaces, plug interfaces, solder point interfaces, digital interfaces, analog interfaces, interfaces that allow for easy attachment or detachment, or any other suitable interface. Each interface 314-326 can be associated with circuitry for receiving and/or interpreting the signals received at each interface. The circuitry can be a part of the interface or mounted to modular chiller controller 212 (e.g., mounted to one or more printed circuit boards associated with modular chiller controller 212). The circuitry for receiving and/or interpreting can also be at least partially included with a processing circuit 302 of controller 212. Interfaces 314-326 can be associated with one or more analog-to-digital converters (if receiving an analog signal), digital-to-analog converters (if receiving a digital signal that is to be processed via analog circuitry), circuitry configured to appropriately filter, limit, and/or amplify received signals, or any other circuitry configured to prepare signals received at the interfaces for use by controller 212. It should be noted that some of interfaces 314-326 may be of different types, voltage ranges, protocols, or otherwise differently configured relative to other of interfaces 314-326.

Referring further to FIG. 3, controller 212 is shown to include processing circuit 302. Processing circuit 302 is preferably configured to control compressor 208, cold fluid valve 116, and expansion valve 210 (e.g., an electronic expansion valve, a mechanical expansion valve, etc.). Processing circuit 302 can be a processing board communicably connected to the main processing circuit board (PCB) for controller 212, can be surface mounted to the main PCB for controller 212, or can otherwise be operably connected to controller 212. Processing circuit 302 can be circuitry distributed throughout controller 212, can be a separate board or boards, can be one more integrated circuits and associated circuitry, or can have any other configuration.

Processing circuit 302 is shown to include a processor 304 and memory 306. Processor 304 can be one or more general or special purpose processors configured to conduct, execute, and/or facilitate the processes and activities described herein. For example, processor 304 can be a general purpose processor configured to execute computer code stored on the memory device or otherwise for facilitating the activities described in the present disclosure. Memory 306 can be a single memory device, multiple memory devices, volatile memory, non-volatile memory or any other suitable electronic memory configured to store or retrieve stored computer code, temporary information, or other data. Processing circuit 302 can be configured to temporarily store, for example, digital representations of the signals received from one or more interfaces. The stored representations can then be analyzed by processor 304 as a part of a control logic loop or for problems (e.g., alarm conditions) that should be communicated to a user and/or another system. In an exemplary embodiment, processing circuit 302 (e.g., memory 306) includes executable computer code (e.g., script code, instruction code, object code, etc.) that configures processor 304 to undertake or facilitate the completion of the logic and control activities described herein with respect to controller 212. For example, in an exemplary embodiment, processor 304 is configured to conduct the logic and control activities described in FIGS. 3 and 4—providing outputs to interfaces 314-326 and/or processing inputs from interfaces 314-326 when appropriate. In an exemplary embodiment, processor 302 (via execution of computer code stored in memory 306 or otherwise) is configured to seek to maintain a superheat setpoint based on suction temperature provided by temperature sensor 218 and suction pressure provided by pressure sensor 216. Referring further to FIG. 3, modular chiller controller 212 is shown to include a power supply (PSU) 312. Power supply 312 can be configured to receive power (AC power or DC power) from a main power supply for the modular compact chiller unit (e.g., PSU 214 shown in FIG. 2) or from another power source.

Referring still to FIG. 3, modular chiller controller 212 is shown to include a display and display circuitry 308. Display 308 can be mounted on the circuit board, mounted on housing or frame 300 for controller 212, or otherwise provided near controller 212 for viewing by a user. Display 308 can be a display of any type (e.g., OLED, dot-matrix, LCD, LED-based, CRT-based, plasma-based, etc.). Display 308 can be configured to display numbers, letters, graphics, and/or any other indicia that can be interpreted by a user. For example, display 308 can be configured to display the current setpoint, current temperature, current suction pressure, current discharge pressure, an error code, a state code, an alarm code, or any other information pertaining to the modular compact chiller unit to which display 308 is coupled. The display circuitry can drive display 308 using information received from processing circuit 302 or processing circuit 302 can include some or all of the circuitry for driving or controlling display 308.

Referring still to FIG. 3, modular chiller controller 212 is shown to include user interface elements and circuitry 310. User interface elements 310 can include one or more user devices (e.g., keyboards, pointing devices, buttons, switches, touchpads, etc.) configured to receive user input for use by controller 212. For example, during installation or service activities a button provided to modular chiller controller 212 could be used to allow the user to toggle between different views on display 308. Using the button, by way of further example, the user can sequence through viewing indicia associated with each interface 314-326 (e.g., a setpoint received at controller interface 316, a duty percentage of the compressor received at compressor interface 318, a pressure reading from pressure sensor interface 320, temperatures, other pressures, alarm codes, setpoint ranges, default settings, etc.). According to an exemplary embodiment, controller 212 not only allows display of readings and settings via display 308, but is also configured to receive user inputs and to change variables or settings of the system based on the received inputs (e.g., button presses, etc.). For example, the controller may be configured to enter a setpoint mode upon a certain combination of button presses. Once the mode is entered, the user may be prompted to scroll to the variable that he or she would like to edit. According to various exemplary embodiments, the following settings are editable via display and display circuitry 308, user interface elements and circuitry 310 and processing circuit 302: refrigerant type, system type, a low pressure at which the controller should shut down the system, a superheat setpoint (e.g., 2-12 deg. F.), a high pressure at which the controller should shut down the system, a maximum number of compressor starts per hour (the use for this variable is explained in FIG. 4), a minimum compressor off time (also explained in FIG. 4 and the accompanying description), a pressure sensor calibration parameter, a temperature sensor calibration number, etc. In other exemplary embodiments, other sets of variables may be set or adjusted via display 308.

Referring now to FIG. 4, a flow chart of a process 400 for starting a modular compact chiller unit that is a part of a larger refrigeration system utilizing a plurality of modular compact chiller units is shown, according to an exemplary embodiment. Process 400 is shown to include the step of waiting for receipt of a new call for cooling signal (step 404). The waiting step can include looping through a first sub step that waits for a period of time (1 second, 5 seconds, etc.), a second sub step that checks for the receipt of a cooling call (e.g., a cooling command, a new setpoint, etc.), and/or any number of other steps. At some point the module will receive the call for cooling signal from the main controller (e.g., main controller 126 shown in FIG. 1, or another device of the system) (step 408). In response to the call for cooling signal, process 400 may include beginning a startup routine (step 409) for the modular compact chiller unit.

As is shown in FIG. 4, exemplary embodiments of process 400 may include a number of checks, determinations, or other steps prior to beginning the startup routine. For example, process 400 is shown to include the step of determining whether a maximum number of starts per hour has been exceeded (step 412). The maximum number of starts per hour may be limited to prevent an overheating condition (e.g., of the compressor) of the compressor. A variable or a table in memory of the controller may be incremented and/or updated with each start of the chiller and used in determining step 412. If the maximum number of starts per hour has been exceeded, process 400 is shown to loop back to waiting for a new call for cooling. According to an exemplary embodiment, waiting for a new call for cooling can include checking to determine whether the maximum number of starts per hour has dropped to an acceptable level. If the maximum number of starts per hour has not been exceeded, then the controller is shown to include the step of determining whether a minimum off-time has expired (step 416). If the minimum off-time has not expired, process 400 loop back to the waiting step (e.g., to wait for a new call for cooling). Other pre-start or conditional checks may be conducted according to various other embodiments.

If the controller determines that startup routine 409 should begin, the controller will activate the chilled fluid valve (e.g., open the chilled fluid valve 116 shown in FIGS. 1 and 2 to allow fluid to flow through the chilled fluid piping near the heat exchanger in the modular compact chiller unit) and open the condenser valve (e.g., valve 128 shown in FIGS. 1 and 2) (step 420). A start delay timer can be started when the fluid valve is opened. When the timer expires (or is otherwise counted), the controller opens the expansion valve (e.g., valve 210 shown in FIG. 2) to a pre-start position (step 424).

The pre-start position to which the expansion valve is controlled may correspond with restricted flow relative to normal operation. This may advantageously allow the refrigerant to accumulate in the condenser more quickly than would otherwise occur during chiller startup.

In an exemplary embodiment, the pre-start positioning of the expansion valve makes use of control logic utilized during normal operation of the expansion valve that adjusts the expansion valve to a superheat setpoint. That is, during the beginning of the startup routine, a startup superheat setpoint may temporarily be used by the controller in place of a normal superheat setpoint to control the expansion valve. The same logic of the controller that seeks to maintain a superheat setpoint during normal operation (e.g., based on pressure and temperature received from sensors 216 and 218 shown in FIG. 2) is provided a higher superheat setpoint (i.e., the startup superheat setpoint). The logic responds to the higher superheat setpoint by, for example, restricting flow through the electronic expansion valve. The startup superheat setpoint may be recalled from memory (step 422) or otherwise derived by the system (e.g., an offset may be added to the original superheat setpoint). For example, if the operating superheat setpoint is +12 degrees Fahrenheit, the startup superheat setpoint may be +15 degrees Fahrenheit and logic for obtaining the startup superheat setpoint may cause the expansion valve to be positioned in a manner calculated to obtain the startup superheat setpoint. In an exemplary embodiment, user interface mechanisms of the chiller controller may be used to adjust the startup superheat setpoint as well as the time for which to hold the startup superheat setpoint (if the time is set to zero, the normal superheat value is used to control the expansion valve).

Referring further to FIG. 4, the startup routine 409 is further shown to include checking for whether a "cut-in" suction pressure at the compressor is achieved (step 426). This determination may include receiving a signal from a pressure sensor (e.g., located on the inlet side of the compressor, located in the compressor, pressure sensor 216 shown in FIG. 2, etc.) and comparing the signal representative of pressure to a threshold. When the pressure checked for in step 426 is obtained, the controller provides a control signal to the compressor for the modular compact chiller unit, causing the compressor to activate for normal operation (step 428).

Referring still to FIG. 4, a timer associated with the startup superheat setpoint is counted and checked for expiration (step 430). Upon expiration of the startup superheat timer, the controller transitions the position for the expansion valve to an operating superheat setpoint (step 432). Once the startup routine is complete, normal operation of the controller and the modular compact chiller unit commences (step 434). Normal operation may include controlling the expansion valve to the normal superheat setpoint using an appropriately placed temperature sensor (e.g., sensor 218 shown in FIG. 2) and/or pressure sensor (e.g., sensor 216 shown in FIG. 2). Normal operation of the chiller can continue unless an alarm or shutdown sequence is triggered.

Referring now to FIG. 5, a process 500 for handling alarm events or chiller shut-down is shown, according to an exemplary embodiment. On a regular basis, the controller can conduct a cycle of checking for a shut-off signal (step 504) or for an alarm condition existing within the system (steps 514, 524). If a shut-off signal is received from the main controller (or from a user interface element coupled to the modular chiller controller) the process includes turning off the chilled fluid valve and the expansion valve (step 506). According to an exemplary embodiment, the chilled fluid valve will remain open for longer than the expansion valve (e.g., until the compressor has spun down and the pressure in the refrigeration loop is relatively low). After the expansion valve is closed, the compressor is turned off when a low pressure set-point is reached (step 508). When the low pressure set-point is reached and the compressor is turned off, the controller closes the condenser valve (step 510). The process then generates a code indicator for providing to the main controller, a local display, and/or to another device (step 512). The code indicator can indicate to a receiving device (or a user viewing a display) that the modular compact chiller unit has been shut off.

Referring further to FIG. 5, process 500 is further shown to include checking for the existence of a serious alarm condition (step 514). If a serious alarm condition is determined to exist, the compressor can immediately be turned off (step 516). The fluid valve, the electronic expansion valve, and the condenser valve can also be closed (e.g., and/or turned off) (steps 518, 520). The controller then generates an alarm code indicator for providing to a main controller or another device (e.g., a local display) (step 522). If a minor alarm condition is determined to exist (step 524), the control board will generate an alarm code indicator (step 526) but otherwise continue normal operation (step 528). Additional "tiers" of alarm conditions can be checked by the controller with varying response levels. According to an exemplary embodiment, operating conditions, alarm settings, codes, and the like can be accessed at each modular compact chiller unit's control board via a display and user interface elements (e.g., buttons).

Figure 6:
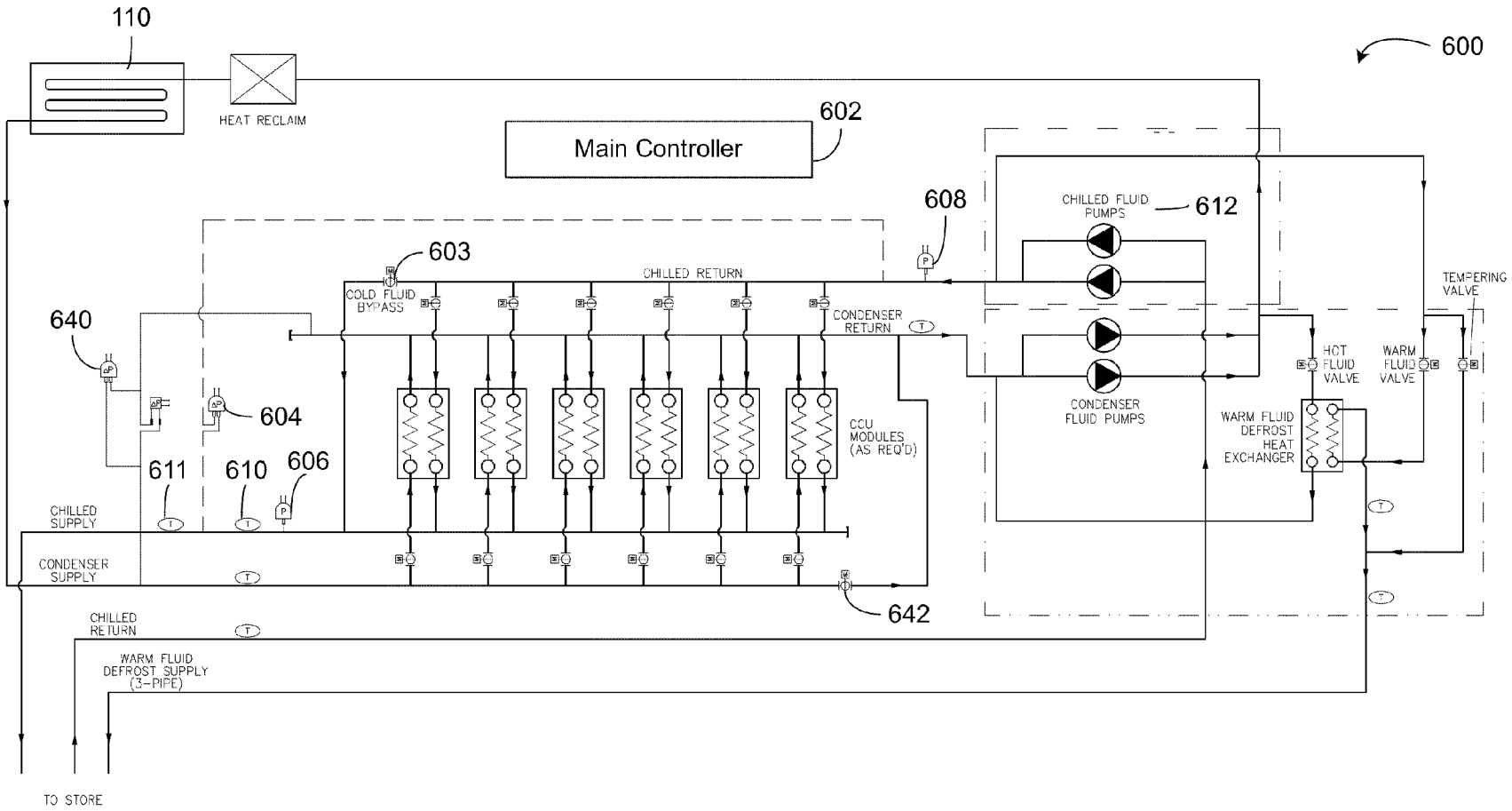
FIG. 6 is a piping diagram for an exemplary refrigeration system that uses modular compact chiller units such as those described herein, according to an exemplary embodiment.
Figure 7:
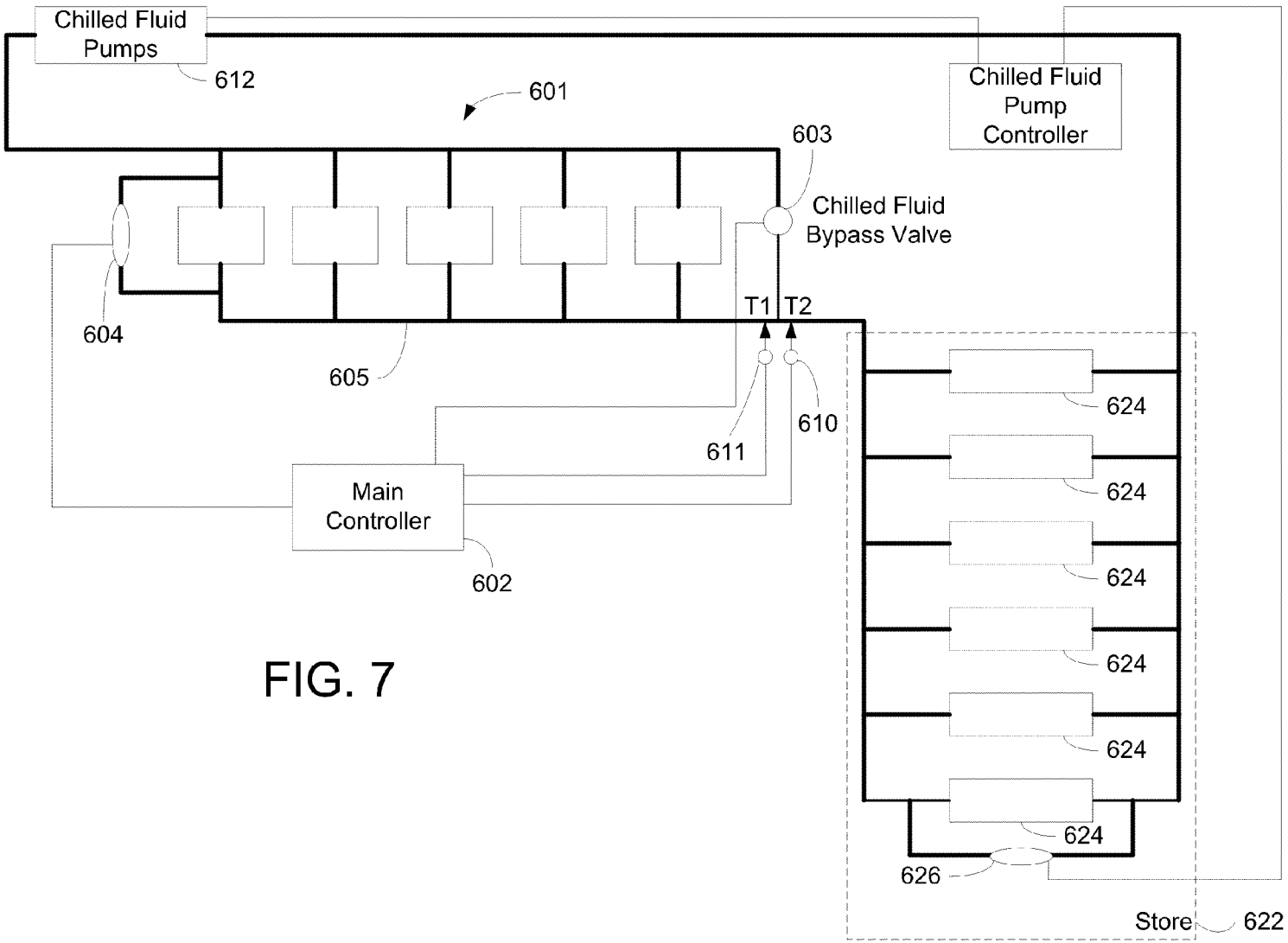
FIG. 7 is a simplified diagram of the chilled fluid path or piping of FIG. 6, according to an exemplary embodiment.

Referring now to FIG. 6, a schematic 600 of piping for an exemplary refrigeration system is shown, according to an exemplary embodiment. FIG. 6 may be a more detailed representation of the refrigeration system shown in FIG. 1 or otherwise. The refrigeration system of FIG. 6 is shown to include six modular chiller units (e.g., modular compact chiller units, "CCU" modules, etc.) and may generally operate as the modular compact chiller units shown and described with reference to FIGS. 1-5. In FIG. 6, main controller 602 is shown without connection lines to the various components of the refrigeration system for clarity, but it should be appreciated that main controller 602 is electrically or wirelessly connected to at least: controllers for each modular chiller unit, chilled fluid bypass valve 603, chilled fluid differential pressure transducer 604, pressure transducers 606, 608, and temperature sensor 610, among other valves, transducers or sensors of the system. FIG. 7 illustrates the chilled fluid path of FIG. 6 via a simplified diagram, according to an exemplary embodiment.

Referring now to FIGS. 6 and 7, a refrigeration system for providing chilled fluid to cooling loads (e.g., refrigeration cases in store 622) is shown, according to an exemplary embodiment. The system is shown to include a main controller 602, a plurality of modular compact chiller units 601, and chilled fluid system piping 605 configured to allow the chilled fluid to be chilled by the plurality of modular compact chiller units 601. Each of the plurality of modular compact chiller units 601 preferably includes a controller configured to receive control signals from the main controller and to provide startup control, operational control, and shutdown control for its associated modular compact chiller unit. It should be noted that while the plurality of modular compact chiller units 601 may be configured according to any one or more of the abovementioned embodiments, chiller units of different configurations may operate within the refrigeration system of FIGS. 6-7.

Main controller 602 may be configured to cause modular compact chiller units 601 to turn on, one at a time, in order to meet a chilled fluid temperature setpoint. For example, when the temperature of the chilled fluid downstream of the plurality of modular compact chiller units 602 (e.g., the temperature sensed by temperature sensor 610 or 611 and provided to the main controller) is greater than a setpoint for the chilled fluid, the main controller may be configured to provide a call for cooling signal (e.g., as previously described) to the controllers for the plurality of modular compact chiller units 601.

In other embodiments, main controller 602 may be configured to turn modular compact chiller units on and off to meet a chilled fluid temperature setpoint in conjunction with the chilled fluid flow rate as determined by differential pressure sensor 604 (e.g., measured across a parallel rack of modular compact chiller units, measured between the supply and return headers for the chiller units, etc.). An exemplary process for providing such control is described below with reference to FIG. 8.

Main controller 602 can be or include one or more programmable logic controllers, a processor programmed with executable computer code, a field programmable gate array, or other suitable hardware for implementing the logic described herein. Any executable computer code may be stored in a computer-readable medium such as random access memory, read only memory, flash memory or hard disk memory.

Figure 8:
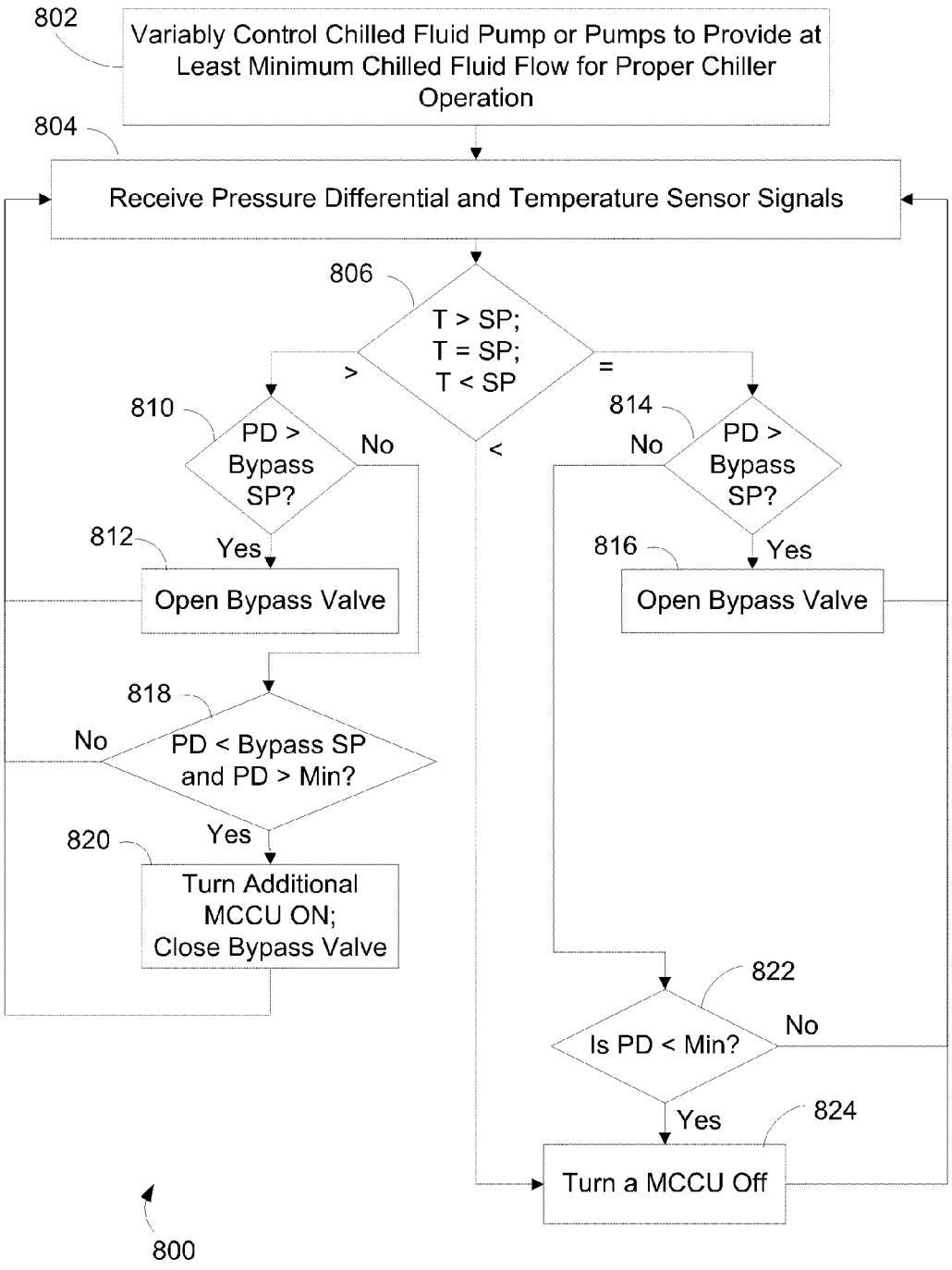
FIG. 8 is a flow chart of a process for the main controller of FIG. 6, according to an exemplary embodiment.

Referring now to FIG. 8, an exemplary process 800 for main controller 602 is shown, according to an exemplary embodiment. While in some embodiments the main controller may be configured to turn the modular compact chiller on or off based entirely on temperature feedback (e.g., from sensor or sensors 610, 611), Applicants have found that a main controller strategy that takes into account chilled fluid system pressure may better avoid inadequate or excessive flow rates in the chilled fluid system. Accordingly, and referring also to FIGS. 6 and 7, differential pressure sensor 604 is configured to provide a signal representative of the pressure differential ("PD" in FIG. 8) of the chilled fluid pressure upstream of the plurality of modular compact chiller units relative to the chilled fluid pressure downstream of the plurality of modular compact chiller units. Process 800 is shown to include variably controlling the chilled fluid pump or pumps (e.g., variable speed pumps, pumps 612 of FIGS. 6 and 7) to provide at least a minimum chilled fluid flow necessary or desired for proper chiller operation (step 802). The pump or pumps may be controlled by the main controller or a separate chilled fluid pump controller (e.g., shown in FIG. 7) that preferably controls flow of the chilled liquid using feedback from an end of loop sensor 626 (e.g., shown in FIG. 7 as downstream of heat exchangers 624). Given a system such as that shown in FIGS. 6 and 7, the following relationships may inform such a controller strategy: a high flow rate of the chilled fluid causes a high pressure differential; a low chilled fluid flow rate causes a low pressure differential; measuring a high pressure differential is the indicator that more chillers are required to satisfy the flow expectations; and measuring a low pressure differential is the indicator that the pumps have slowed.

Referring again to FIG. 8, as well as FIGS. 6 and 7, process 800 is further shown to include receiving pressure differential and temperature sensor signals (e.g., from sensors 604, 610, 611 (step 804). The main controller may continuously loop though one or more decision steps 806 to determine whether temperature of the chilled fluid (e.g., temp T2 sensed by temperature sensor 610) is equal to the temperature setpoint (setpoint is abbreviated "SP" in FIG. 8) for the chilled fluid, less than the setpoint, or greater than the setpoint. In parallel with or as a part of process 800, controller 602 or the chilled fluid pump controller may be configured to monitor sensor 610 and to control it to a desired setpoint (e.g., by adjusting pumping speed, by changing a setpoint provided to the modular compact chiller units, etc.). In such a control scheme, a high fluid temperature may cause the differential pressure provided by sensor 604 to float down. Low fluid temperature, by contrast, will cause the pressure differential to float up.

If the pressure differential provided to main controller 602 by differential pressure sensor 604 is greater than a bypass setpoint (e.g., a point at which it is determined that relief of pressure relative to the compact chiller units is desired, a safety pressure threshold, etc.) (step 810), the main controller is configured to cause some of the chilled fluid to bypass the plurality of modular compact chiller units 601 (step 812). The main controller may cause some of the chilled fluid to bypass the plurality of modular compact chiller units by, for example, opening (e.g., in a binary fashion, variably, etc.) chilled fluid bypass valve 603. In other exemplary embodiments, valve 603 is not a bypass valve but rather is a relief valve that provided some of the chilled fluid back to a collection tank. The bypass setpoint may be selected or determined during system setup by choosing a number over a normal operation condition so that the bypass activity is only required during abnormal conditions. For example, in some embodiments where the modular compact chiller units operate normally with between a 4 psi and 12 psi pressure differential between the headers, the bypass setpoint may be set at 12 psi so that it is closed at a differential pressure less than 12 psi.

Process 800 is further shown to include the step of determining whether the pressure differential is less than the bypass setpoint and whether the pressure differential is greater than a minimum pressure differential (step 818). If the answer to decision step 818 is yes, main controller 602 may provide an "on" signal to the next modular compact chiller unit 601 (MCCU in FIG. 8) (step 820). If bypass valve 603 is open, main controller 602 may cause it to be closed when an additional MCCU is turned on (e.g., to ensure flow is sustained for the newly online MCCU). When temperature is determined to be less than setpoint at decision step 806, main controller 602 may cause an MCCU unit to turn off (step 824). In this instance, the main controller will turn an MCCU off to ensure that the chilled fluid does not become too chilled and the MCCU's can continue operating efficiently.

When temperature is equal to setpoint (or near within an acceptable band of values), main controller 602 may determine whether the pressure differential is greater than a bypass setpoint (step 814) and open the bypass valve (step 816) if the determination is yes (e.g., to drop pressure without affecting the number of MCCUs online). If the temperature is equal to setpoint (or near within an acceptable band of values), and the pressure differential is not greater than the bypass setpoint, the system will then check to determine whether the pressure differential is less than a minimum value (step 822). If the pressure is less than a minimum value, the system turns an MCCU off (step 824). In this instance, the main controller will turn an MCCU off to ensure that the MCCUs that remain running have a sufficient fluid flow and/or so that the pressure differential sensed by differential pressure sensor 604 increases.

In other exemplary embodiments, other load control algorithms may be provided to determine when and which modular compact chiller units to turn on or off. Some algorithms may include fixed steps or ordering for the chiller units while other algorithms may alternate chiller units to be "first on" or "first off".

Referring still to FIGS. 6 and 7, it should be noted that the condenser fluid system may include its own controller or be controlled by a main controller. The controller that controls condenser fluid system may be configured to maintain a continuous warm fluid flow to the condenser portions of the active modular compact chiller units. In an exemplary embodiment, condenser fluid may be maintained within a temperature range of between 120 deg. F. and 55 deg. F. Such a temperature may be controlled by, for example, fan cycling. As shown in FIG. 6, the condenser fluid system may also include a differential pressure transducer 640 and a bypass valve 642 for allowing excess pressure to bypass the condenser portions of modular compact chiller units 601. Differential pressure transducer 640 levels may also cause the condenser fluid pumps to variably adjust the pressure of the condenser fluid in the system, if the pump system is equipped with variable speed capability. Another differential pressure switch may be installed across the modular compact chiller units warm fluid headers that ensures flow and protects the modular compact chiller units if, for example, the valves are shut-off on one bank of modular compact chiller units while the other bank continues to operate. This switch is installed in such a way as to disable the modular compact chiller unit if warm fluid flow were to cease. This modular compact chiller unit logic may be implemented on the controller for each modular compact chiller or otherwise. Warm condenser fluid may be used to provide warm fluid flow to a defrost heat exchanger as shown in FIG. 6.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

According to an exemplary embodiment, control for the compressor, expansion valve, and fluid valve are integrated into a single controller (e.g., a single control board). According to various other exemplary embodiments, the control activities described herein can be accomplished by two control boards; one for expansion valve control and another for control of the rest of the modular chiller unit.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A controller for a modular compact chiller unit configured for integration into a refrigeration system utilizing a plurality of modular compact chiller units, the controller comprising:

a plurality of modular compact chiller units, wherein each modular compact chiller unit includes a controller comprising: an expansion valve interface configured to provide control signals to an expansion valve of the modular compact chiller unit; a compressor interface configured to provide control signals to a compressor of the modular compact chiller unit; and a processing circuit configured to provide startup control, operational control, and shutdown control for the modular compact chiller unit, wherein each of the of plurality of controllers provides control signals to a discrete modular compact chiller unit; and a main controller configured to provide control signals to the plurality of controllers, wherein the plurality of modular compact chiller units operate in parallel to provide chilling for a single chilled fluid system;

wherein the startup control comprises:

beginning opening an expansion valve to a pre-start position after a delay time has expired; while the expansion valve is in the pre-start position, receiving a signal from a pressure sensor, the signal representative of the pressure on the inlet side of a compressor for the modular compact chiller unit;

while the expansion valve is in the pre-start position, comparing the signal representative of the pressure to a threshold; and while the expansion valve is in the pre-start position, providing a control signal to the compressor for the modular compact chiller unit that causes the compressor to activate for normal operation when the pressure meets or exceeds the threshold.

2. The refrigeration system controller of claim 1, wherein the startup control further comprises:

comparing a number of starts per hour value for the modular compact chiller unit to a threshold value; and refraining from beginning the startup routine when the number of starts exceeds the threshold value.

3. The refrigeration system controller of claim 1, wherein the startup control further comprises:

recalling a startup superheat setpoint from memory;

controlling the pre-start position for the expansion valve based on the startup superheat setpoint recalled from memory, based on a newly received signal from a temperature sensor configured to sense the temperature of superheat vapor, and based on a newly received signal from a pressure sensor configured to sense the pressure of the superheat vapor; and continuing to control the expansion valve according to the startup superheat setpoint for a predetermined period of time before controlling the expansion valve for an operating superheat setpoint rather than the startup superheat setpoint.

4. The refrigeration system controller of claim 1, wherein the operational control comprises:

calculating adjustments to an expansion valve based on a superheat setpoint and inputs from at least a temperature sensor; and providing control signals to the expansion valve based on the calculated adjustments.

5. The refrigeration system controller of claim 1, wherein the startup control comprises:

providing a signal to a chilled fluid valve so that chilled fluid begins flowing past an evaporator portion of the modular compact chiller unit; and providing a signal to a condenser fluid valve so that condenser fluid begins flowing past an a condenser portion of the modular compact chiller unit.

6. The refrigeration system controller of claim 5 wherein the shutdown control comprises:

providing a signal to the chilled fluid valve that is configured to close the chilled fluid valve;

providing a signal to the condenser fluid valve that is configured to close the condenser fluid valve;

providing a signal to the expansion valve that is configured to close the expansion valve; and turning off the compressor when a low pressure setpoint at the compressor has been reached.

7. The refrigeration system controller of claim 6, wherein the shutdown control further comprises:

causing an electronic display to display a representation of the reason for the shutdown.

8. A refrigeration system for providing chilled fluid to cooling loads, the refrigeration system comprising:

a main controller;

a plurality of modular compact chiller units;

a chilled fluid system configured to allow the chilled fluid to be chilled by the plurality of modular compact chiller units;

wherein each of the plurality of modular compact chiller units includes a controller configured to receive control signals from the main controller and to provide startup control, operational control, and shutdown control for its associated modular compact chiller unit;

wherein the main controller is configured to cause some of the chilled fluid to bypass a set of more than one of the plurality of modular compact chiller units when the chilled fluid temperature is equal to or greater than the chilled fluid temperature setpoint and the pressure differential of the chilled fluid pressure upstream of the plurality of modular compact chiller units relative to the chilled fluid pressure downstream of the plurality of modular compact chiller units is above a setpoint differential pressure, and wherein the fluid that bypasses the set of more than one of the plurality of modular heat exchangers is recirculated.

9. The refrigeration system of claim 8, wherein the main controller is configured to cause the modular compact chiller units to turn on, one at a time, in order to meet a chilled fluid temperature setpoint.

10. The refrigeration system of claim 9, wherein the main controller is configured to discontinue causing some of the chilled fluid to bypass the modular compact chiller units when the pressure differential is less than the setpoint differential pressure.

11. The refrigeration system of claim 10, wherein the main controller is configured to cause a modular compact chiller unit of the system to turn off when the pressure differential is less than a minimum differential pressure, wherein the minimum differential pressure is less than the setpoint differential pressure, temperature of the chilled fluid is less than the chilled fluid temperature setpoint.

12. A method for starting a modular compact chiller unit that is a part of a larger refrigeration system utilizing a plurality of modular compact chiller units, the method comprising:

receiving a call for cooling signal from a main controller for the refrigeration system;

in response to the call for cooling signal, beginning a startup routine comprising:

beginning opening an expansion valve to a pre-start position after a delay time has counted, while the expansion valve is in the pre-start position, receiving a signal from a pressure sensor representative of the pressure on the inlet side of a compressor for the modular compact chiller unit, while the expansion valve is in the pre-start position, comparing the signal representative of pressure to a threshold, and while the expansion valve is in the pre-start position, providing a control signal to the compressor for the modular compact chiller unit causing the compressor to activate for normal operation when the pressure meets or exceeds the threshold.

13. The method of claim 12, further comprising:

providing a signal to a chilled fluid valve so that chilled fluid begins flowing past an evaporator portion of the modular compact chiller unit; and providing a signal to a condenser fluid valve so that condenser fluid begins flowing past an a condenser portion of the modular compact chiller unit.

14. The method of claim 12, wherein the startup routine further comprises:

recalling a startup superheat setpoint from memory;

controlling the pre-start position for the expansion valve based on the startup superheat setpoint recalled from memory, a signal from a temperature sensor configured to sense the temperature of superheat vapor, and a pressure sensor configured to sense the pressure of the superheat vapor; and waiting a time period before transitioning from controlling the expansion valve based on the startup superheat setpoint to controlling the expansion valve based on an operating superheat setpoint.

15. The method of claim 12, further comprising:

in response to receiving the call for cooling signal, comparing a number of starts per hour value to a threshold value; and refraining from beginning the startup routine when the number of starts exceeds the threshold value.

16. The method of claim 12, further comprising:

in response to receiving the call for cooling signal, comparing a time since the modular compact chiller unit was last active to a threshold value; and refraining from beginning the startup routine when the time since the modular compact chiller unit was last active is shorter than the threshold.

17. The method of claim 12, further comprising:

coupling the modular compact chiller unit to the larger refrigeration system by connecting pipes from a condenser fluid system and chilled fluid system to inputs and outputs of the modular compact chiller unit.

* * * * *